US007708212B1

(12) United States Patent
Conn

(10) Patent No.: US 7,708,212 B1
(45) Date of Patent: May 4, 2010

(54) NOZZLE ASSEMBLY

(75) Inventor: Dominic Conn, Tempe, AZ (US)

(73) Assignee: Paramount Pool & Spa Systems, Chandler, AZ (US)

( * ) Notice: Subject to any disclaimer, the term of this patent is extended or adjusted under 35 U.S.C. 154(b) by 390 days.

(21) Appl. No.: 11/683,692

(22) Filed: Mar. 8, 2007

(51) Int. Cl.
*A62C 31/02* (2006.01)
*B05B 1/00* (2006.01)

(52) U.S. Cl. ..... 239/600; 239/589

(58) Field of Classification Search ..... 239/600, 239/201, 203–206, 451, 452, 533.9, 533.11, 239/589, 590; 4/490, 492
See application file for complete search history.

(56) References Cited

U.S. PATENT DOCUMENTS 2,214,852 A 9/1940 De Lacy-Mulhall
3,408,006 A 10/1968 Stanwood
3,675,252 A 7/1972 Ghiz
4,271,541 A 6/1981 Mathews
4,322,860 A 4/1982 Gould
4,371,994 A 2/1983 Mathews
4,466,142 A 8/1984 Gould
4,471,908 A 9/1984 Hunter
4,919,337 A * 4/1990 Van Leeuwen et al. ..... 239/205
4,939,797 A 7/1990 Goettl
5,251,343 A 10/1993 Goettl
5,333,788 A 8/1994 Hadar
5,845,849 A * 12/1998 Mitzlaff ..... 239/203
6,301,723 B1 10/2001 Goettl
6,367,098 B1 4/2002 Barnes
6,393,629 B1 5/2002 Barnes et al.
6,438,766 B1 8/2002 Capdevila Arnau
6,488,218 B1 * 12/2002 Townsend et al. ..... 239/205
6,848,124 B2 2/2005 Goettl
7,168,634 B2 * 1/2007 Onofrio ..... 239/222.17

* cited by examiner

*Primary Examiner*—Davis Hwu
(74) *Attorney, Agent, or Firm*—Booth Udall, PLC

(57) ABSTRACT

A nozzle assembly that includes upper and lower washers and a cam. A particular implementation of a nozzle assembly includes a stem coupled with a cam assembly. The stem has a nozzle in a first end which is in fluid communication with a second end of the stem. An upper washer is slidably coupled with a washer race in the stem and may have an upper washer groove and a lower washer may be coupled with the second end of the stem and have a lower washer groove. A spring element may be disposed around the stem between the upper and lower washer grooves. Particular implementations of a cam assembly may include a lower cam half slidably coupled into an upper cam half. Other particular implementations may further include the lower cam half rotationally and, in some implementations, removably indexed in relation to the upper cam half.

18 Claims, 6 Drawing Sheets

NOZZLE ASSEMBLY

BACKGROUND

1. Technical Field

Aspects of this document relate generally to nozzles used to direct the flow of water or other liquids.

2. Background Art

Nozzles are often used to control the flow of water or other liquids. When immersed, nozzles create movement of the bulk liquid in a certain direction. For example, when a series of nozzles are embedded in the floor of a swimming pool, water flow through nozzles can be used to move contaminants on the pool floor toward a pool drain through entrainment in the water streams exiting the nozzles. Often, nozzles used in swimming pool applications contain components that allow their position to be automatically adjusted after each period of use to enable gradual cleaning of the entire surface of pool floor.

SUMMARY

Particular implementations of a nozzle assembly include upper and lower washers with grooves configured to engage with a spring element and cams that include upper and lower halves.

In one aspect, a particular implementation of a nozzle assembly includes a stem coupled with a cam, the stem having a nozzle in a first end which is in fluid communication with a second end of the stem. An upper washer may be slidably coupled with a washer race in the stem and may have an upper washer groove. A lower washer may be coupled with the second end of the stem and have a lower washer groove. A spring element may be disposed around the stem between the upper and lower washer grooves.

In another aspect, a particular implementation of a nozzle assembly may have a stem coupled with a cam assembly. The stem may have a nozzle in a first end and the first end may be in fluid communication with a second end of the stem. The cam assembly may include an upper cam half and a lower cam half slidably coupled into the upper cam half. An upper washer may be slidably coupled with a washer race in the stem and have an upper washer groove and a lower washer may be coupled with the second end of the stem and have a lower washer groove. A spring element may be disposed around the stem between the upper and lower washer grooves.

In particular implementations of a nozzle assembly, the second end of the stem may have a plurality of flexible prongs. The lower washer may also include at least one inwardly extending projection configured to engage with the washer race in the stem. Implementations may also include an upper washer with a first mating element and a lower washer with a second mating element where the first and second mating elements are configured to engage with each other. In particular implementations, the upper washer may be biased against the cam or cam assembly through the spring element.

In some implementations, the lower cam half may include a plurality of cam teeth having identical dimensions. In other implementations, the lower cam half may include a plurality of cam teeth having at least one cam tooth that differs in dimension from the other cam teeth. In other particular implementations, the lower cam half may include cam teeth that all differ from each other in dimensions.

In another aspect, a nozzle assembly may be assembled through a method including the steps of providing a stem having a first end and a second end where the first end includes a nozzle. A cam may be slidably engaged with the stem from the second end of the stem and an upper washer may be coupled to the stem from the second end of the stem after slidably engaging the cam. A spring element may then be coupled to the stem from the second end of the stem after coupling the upper washer to the stem. A lower washer may then be coupled to the stem from the second end of the stem after coupling the spring element to the stem.

In particular implementations of a nozzle assembly, the step of slidably engaging the cam with the stem from the second end of the stem further includes slidably engaging a first cam half with the stem from the second end of the stem and then slidably engaging a second cam half with the stem from the second end of the stem. In implementations, the step of slidably engaging a second cam half with the stem from the second end of the stem further includes slidably coupling the second cam half into the first cam half. Implementations may also include a plurality of flexible prongs that retain the lower washer.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended nozzle assembly and/or assembly procedures for a nozzle assembly will become apparent for use with implementations of nozzle assemblies from this disclosure. Accordingly, for example, although particular stems, cams, spring elements, and washers are disclosed, such stems, cams, spring elements, and washers and implementing components may comprise any shape, size, style, type, model, version, measurement, concentration, material, quantity, and/or the like as is known in the art for such stems, cams, spring elements, and washers and implementing components, consistent with the intended operation of a nozzle assembly.

Structure

Figure 1:
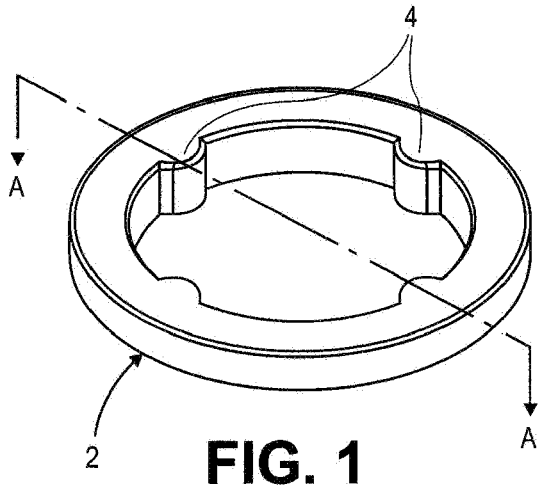
FIG. 1 is a perspective view of an upper washer showing the sectional line A.
Figure 2:
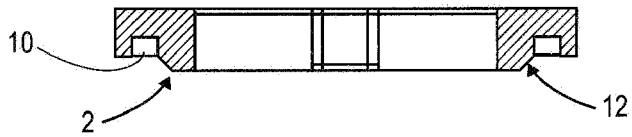
FIG. 2 is a cross section view of the upper washer of FIG. 1 taken along the sectional line A.
Figure 4:
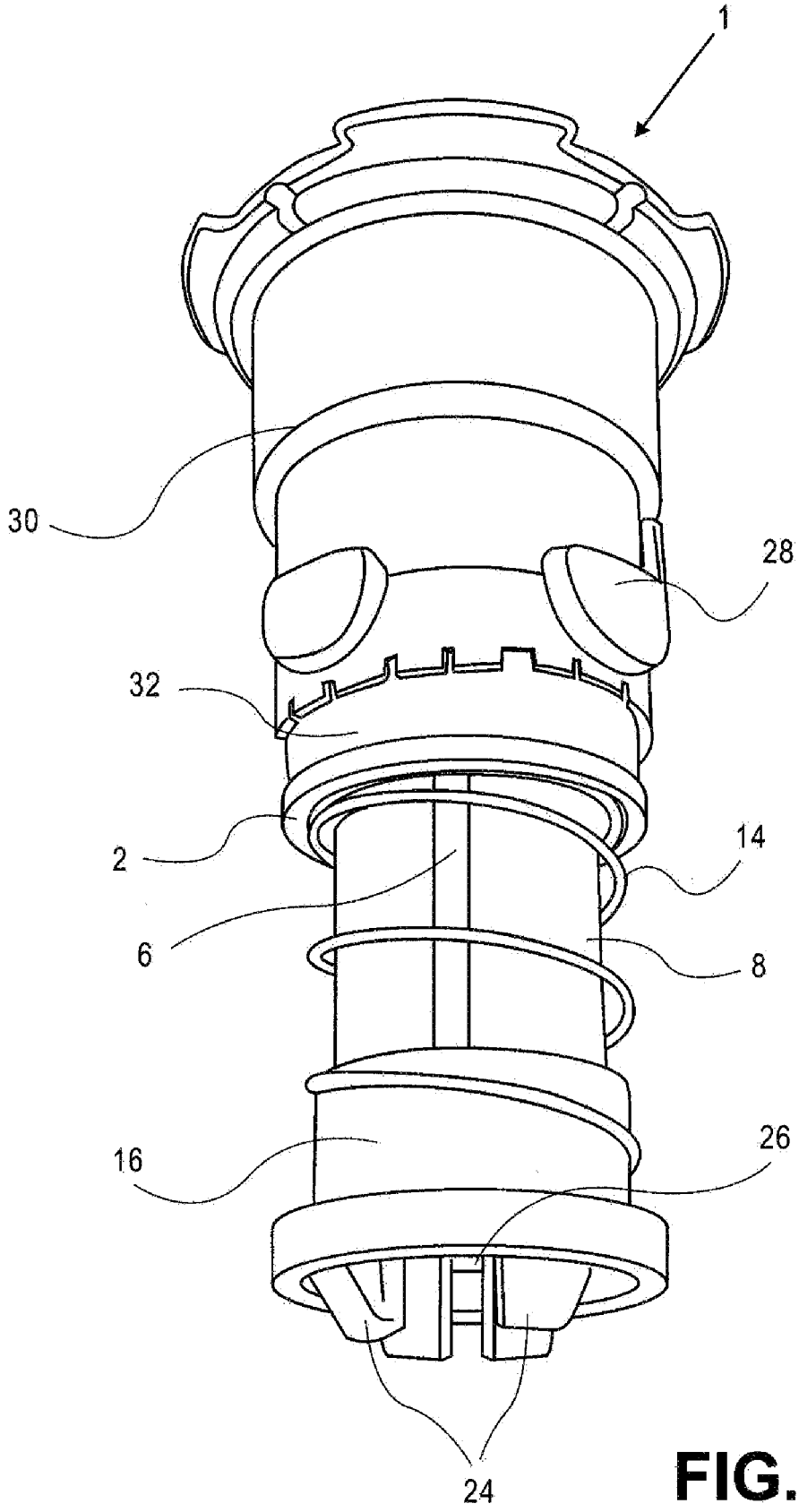
FIG. 4 is a perspective view of a nozzle assembly in a retracted position.

Referring to FIGS. 4 and 1, a particular implementation of a nozzle assembly 1 and an upper washer 2, respectively, are illustrated. The upper washer 2 may include a ring with a plurality of projections 4 extending inward configured to engage with a washer race 6 on a stem 8. The projections 4 may allow the upper washer 2 to slide upward and downward in or on the washer race 6 along the stem 8. FIG. 2 illustrates a cross section view of the upper washer 2 along the sectional line A. The upper washer 2 may have an upper washer groove 10 on one side sized to engage with a spring element 14 like that illustrated in FIG. 4. The upper washer groove 10 may allow the spring element 14 to rotate freely under compression and may help center the spring element 14 relative to the stem 8. The upper washer isolates the spring element 14 from the lower cam half 32. In implementations where they are used, these characteristics of an upper washer groove 10 may reduce the likelihood of spring windup and jamming as the nozzle assembly 1 is repetitively moved from a retracted to an extended position during operation. The use of an upper washer groove 10 may also keep the spring element 14 centered around the stem 8 core so it does not slip off the edge of the upper washer 2. The upper washer 2 may also include a first mating element 12, and as FIG. 2 illustrates, the first mating element 12 may be a bevel in particular implementations.

Figure 3:
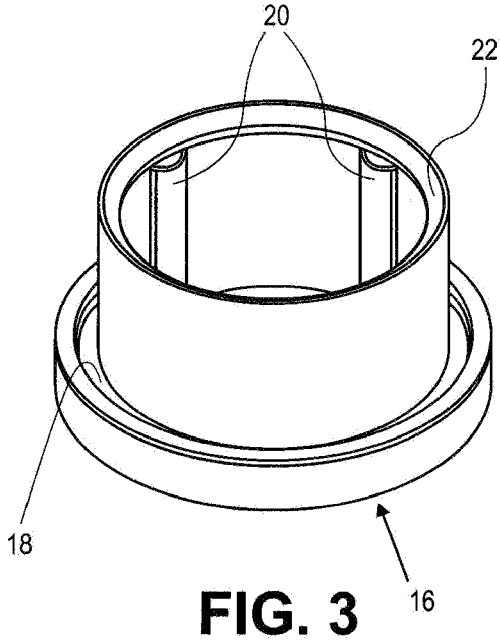
FIG. 3 is a perspective view of a lower washer.

FIG. 3 illustrates a particular implementation of a lower washer 16. The lower washer 16 may include a lower washer groove 18 configured to engage with a spring element 14 like that illustrated in FIG. 4. The lower washer 16 may also include projections 20 that are sized and positioned to correspond to the washer race 6 in the stem 8. The lower washer 16 may also include a second mating element 22 that, as illustrated in FIG. 3, may be a bevel in particular implementations. The second mating element 22 of the lower washer 16 may be configured to engage with the first mating element 12 of the upper washer 2, and may also serve to restrict the flow of liquid around the outside of the stem 8.

Referring to FIG. 4, a particular implementation of an upper washer 2, a spring element 14, and a lower washer 16 are illustrated assembled over a stem 8. As illustrated, the lower washer 16 may be retained through a plurality of flexible prongs 24 at the second end 26 of the stem 8. In other particular implementations of a stem 8, other methods of retaining the lower washer 16 may be used including, by non-limiting example, a clip-on cap, a screw-on cap, or a lower washer 16 that clips or screws onto the second end 26 of the stem 8.

Figure 5:
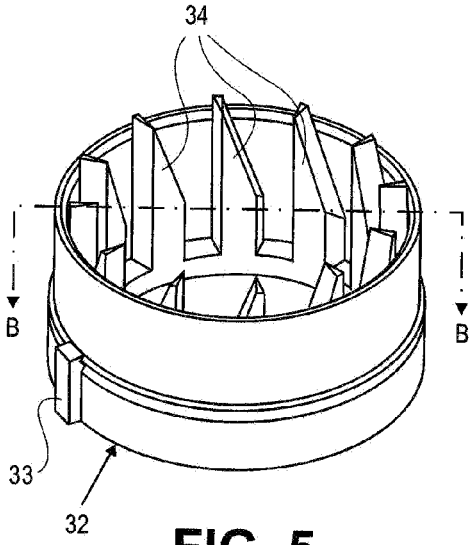
FIG. 5 is a perspective view of a lower cam half showing the sectional line B.
Figure 6:
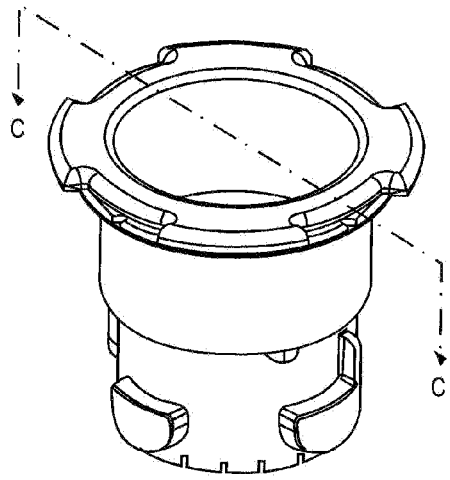
FIG. 6 is a perspective view of an upper cam half showing the sectional line C.
Figure 7:
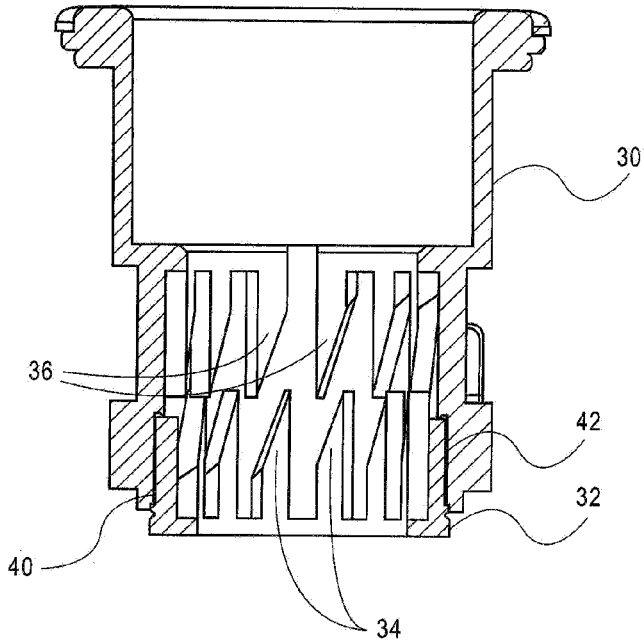
FIG. 7 is a cross section view of the lower cam half slidably coupled into the upper cam half taken along the sectional lines B and C in FIGS. 5 and 6.

FIG. 4 also illustrates that in particular implementations of a nozzle assembly 1, the upper washer 2 may be biased by the spring element 14 against a retainer 28. In particular implementations the retainer 28 may include two portions, a first portion 30 comprising an upper cam half and a second portion 32 comprising a lower cam half. FIGS. 5 and 6 show particular implementations of the lower and upper cam halves 32, 30, respectively. As illustrated, the lower cam half 32 may include a plurality of cam teeth 34. Referring to FIG. 7, a cross section view along the sectional lines B and C in FIGS. 5 and 6 of a particular implementation of an upper cam half 30 and a lower cam half 32 slidably coupled is illustrated. As shown, the upper cam half 30 may have a plurality of upper cam teeth 36. Below the upper cam teeth 36 may be a bottom edge 42 of the upper cam half 30 configured to slidably couple over an upper edge 40 of the lower cam half 32. Index 33 maintains a rotationally indexed relationship between the upper cam half 30 and the lower cam half 32 when the upper cam half 30 and the lower cam half 32 are coupled together. The index 33 fits with a corresponding recess on the retainer 28 and may be configured such that the upper cam half 30 and lower cam half 32 are removably coupled. The index 33, although configured in this example implementation as a rectangular projection may alternatively be configured in any other indexable shape or even as a recess (with corresponding structure on the retainer 28 or upper cam half 30) rather than as a projection. As illustrated in FIG. 7, although the lower cam half 32 is slidably coupled into the upper cam half 30, not all of the lower cam half 32 is necessarily within the upper cam half 30; just the portion corresponding to the upper edge 40.

The cam teeth 34 of the lower cam half 32 and the upper cam teeth 36 are oriented in an alternating fashion to allow the stem 8 to move rotationally by use of a cam pin 52 as the nozzle assembly 1 is alternately activated and deactivated. Referring to FIGS. 4 and 7, since the lower cam half 32 in that implementation is configured to slidably couple into the upper cam half 30 in the direction of the bias applied to the upper washer 2 by the spring element 14, the bias of the spring element 14 discourages separation of the upper and lower cam halves 30, 32. In addition, since the lower cam half 32 couples into the upper cam half 30 in the direction of the pressure gradient through the nozzle assembly 1, the force generated by liquid pressure on the nozzle assembly 1 serves to further unite the upper and lower cam halves 30, 32. Accordingly, particular implementations of the two part cam assembly may be assembled without the need for an adhesive because the spring element 14 and water pressure force the two parts together rather than apart.

Figure 8A:
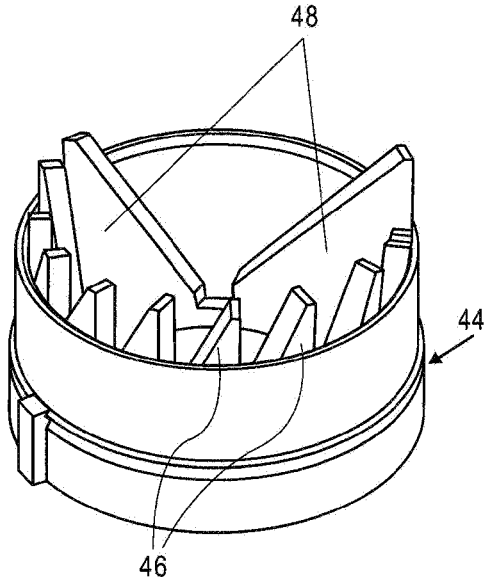
FIG. 8A is a perspective view of a particular implementation of a lower cam half with cam teeth of varying dimensions
Figure 8B:
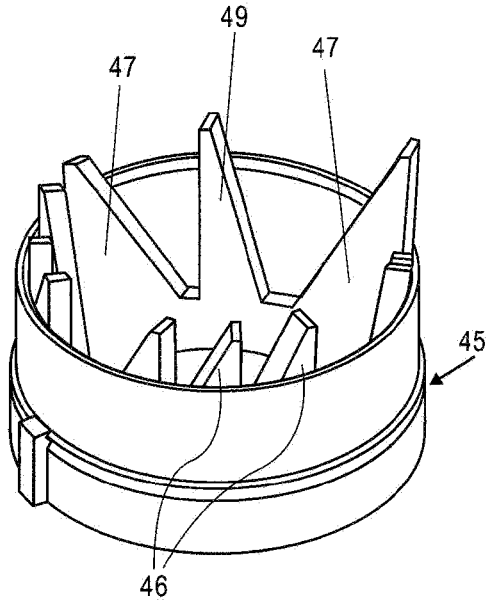
FIG. 8B is a perspective view of another particular implementation of a lower cam half with cam teeth of varying dimensions.

Referring to FIG. 8A, a particular implementation of a lower cam half 44 is illustrated. As shown, the lower cam half 44 includes a set of first cam teeth 46 with substantially the same dimensions and a set of second cam teeth 48 with different dimensions. The different sizes of the cam teeth may permit the nozzle assembly 1 to rotate in steps of varying length while in use. This feature of the nozzle assembly 1 allows the assembly to avoid or minimize time spent spraying obstacles like stairs or walls when the nozzle assembly 1 is installed close to an edge in a swimming pool. Referring to FIG. 8B, as illustrated, in other particular implementations, the cam teeth may all be of the same dimensions, may all differ in dimensions, or the spacing of the teeth around the circumference of the lower cam half may be irregular depending on the desired application of a nozzle assembly 1. In the implementation of a lower cam half 45 illustrated by FIG. 8B, two of the first cam teeth 46 are missing while the two second cam teeth 47 have a third cam tooth 49 of a smaller dimension between them.

Figure 9:
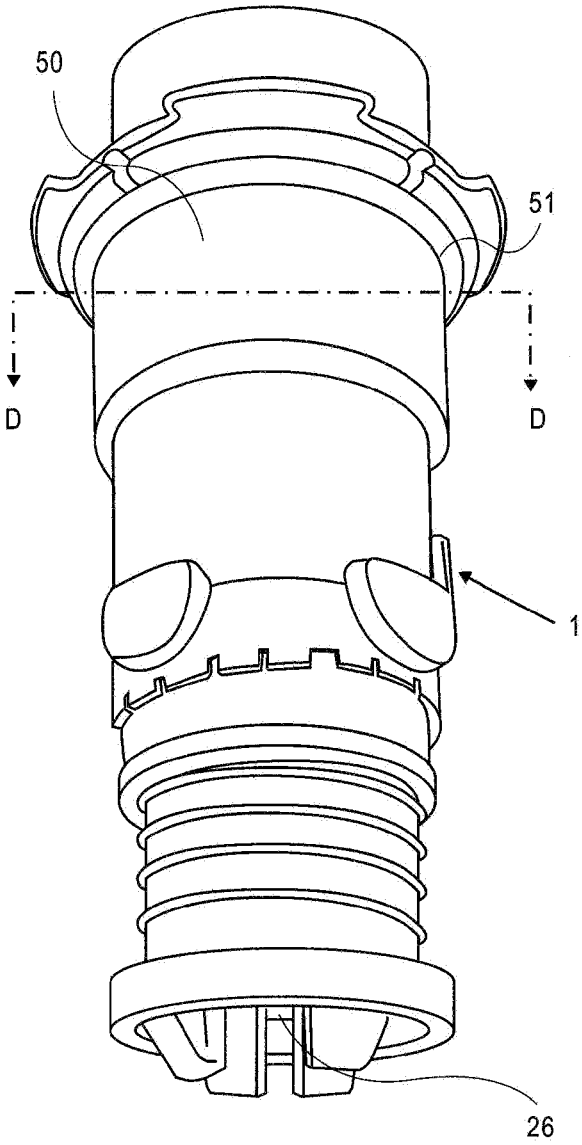
FIG. 9 is a perspective view of a nozzle assembly in an extended position showing the sectional line D.
Figure 10:
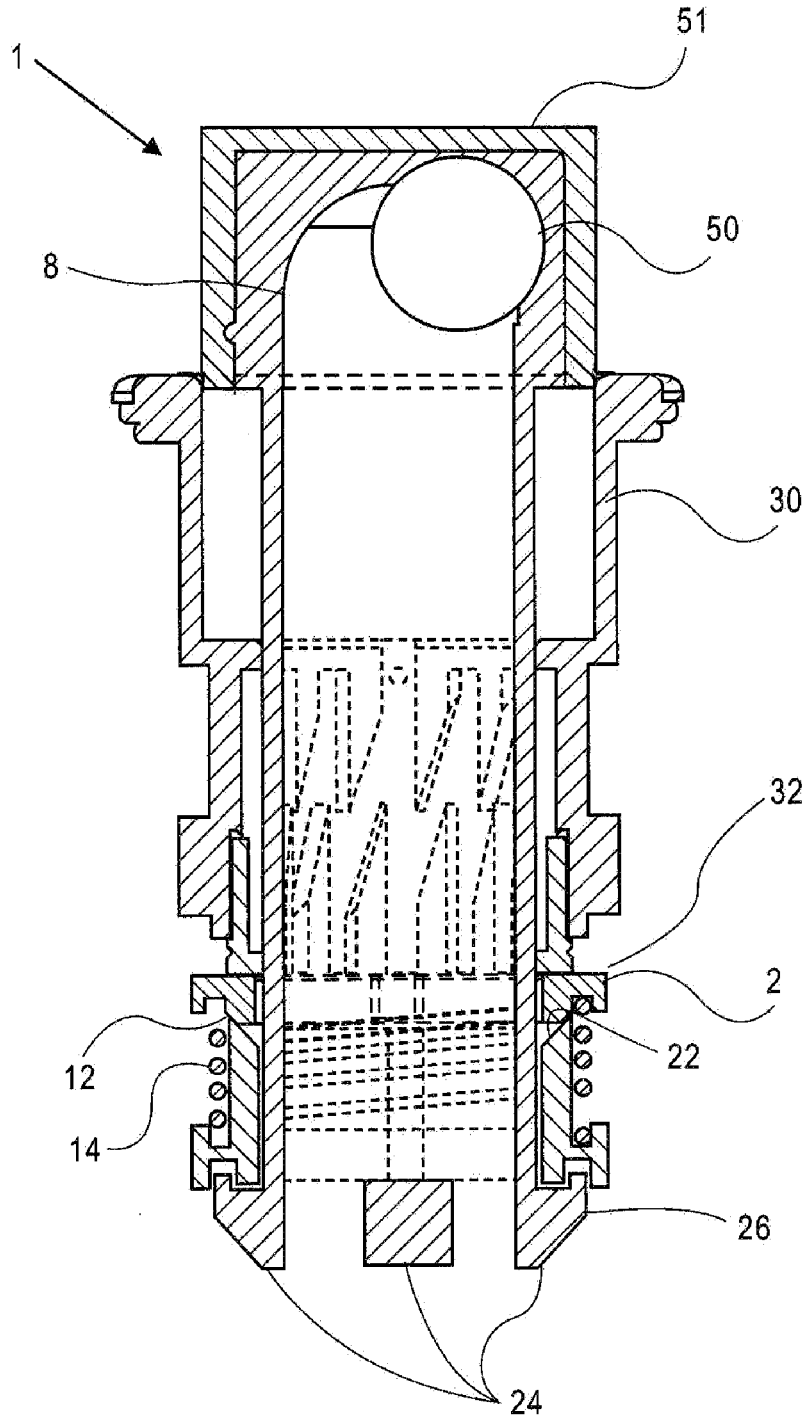
FIG. 10 cross section view of the nozzle assembly of FIG. 9 taken along the sectional line D.

Referring to FIGS. 9 and 10, a cross section view of a nozzle assembly 1 along the sectional line D shown in FIG. 9 is illustrated in an extended position where the nozzle 50 in a first end 51 of the stem 8 is raised above the upper cam half 30. As illustrated, in particular implementations, the upper washer 2 and the lower washer 16 may be located outside of both the upper and lower cam halves 30,32 and may be located below the lower cam half 32. Because the upper and lower washers 2, 16 are located below the lower cam half 32, the bias provided by the spring element 14 may help ensure the lower cam half 32 remains slidably coupled into the upper cam half 30.

The materials used for particular implementations of a nozzle assembly may be those used conventionally including, by non-limiting example, plastics, metals, composites and the like. Particular implementations may include stems made of Dow Isoplast 202EZ, upper and lower cam halves made of ASA Diamond S-950 or Luran S797 S, upper and lower washers made of polypropylene Montel 6323, cam pins and spring elements made of 303 passivated stainless steel. Those of ordinary skill in the art will readily be able to select appropriate materials for nozzle assemblies using the principles disclosed in this document.

Use

FIG. 9 illustrates a particular implementation of a nozzle assembly 1 in an extended position, where the nozzle 50 in a first end 51 of the stem 8 is visible and is in fluid connection with the second end 26. FIG. 10 illustrates a cross section view of the implementation shown in FIG. 9 along the sectional line D. The nozzle assembly 1 moves to the extended position when water pressure from a pump sufficient to compress the spring element 14 is supplied to raise the nozzle 50 in the first end 51 of the stem 8 above the level of the upper cam half 30. In the extended position, water from the pump is free to flow out of the nozzle 50. To aid in restricting flow around the stem 8 while the nozzle assembly 1 is extended, the spring element 14 may compress the upper washer 2 against the lower cam half 32 and water pressure may compress the second mating element 22 of the lower washer 16 against the first mating element 12 of the upper washer 2 while the lower washer 16 engages with the washer races and second end 26 of the stem 8. In particular implementations, the lower washer 16 may not engage the washer races of the stem 8. Water flow around the stem 8 may be reduced, forcing a majority of the water from the pump to flow through the stem 8 out the nozzle 50. When it is no longer necessary for the nozzle assembly 1 to be used, the pump pressure may be removed from the assembly, and the bias in the spring element 14 may retract the nozzle 50 back down into the upper cam half 30, and the lower washer 16 may disengage partially from the washer races and the second end 26 of the stem 8 and rest against the flexible prongs 24 attached to the second end 26 of the stem 8.

Figure 11:
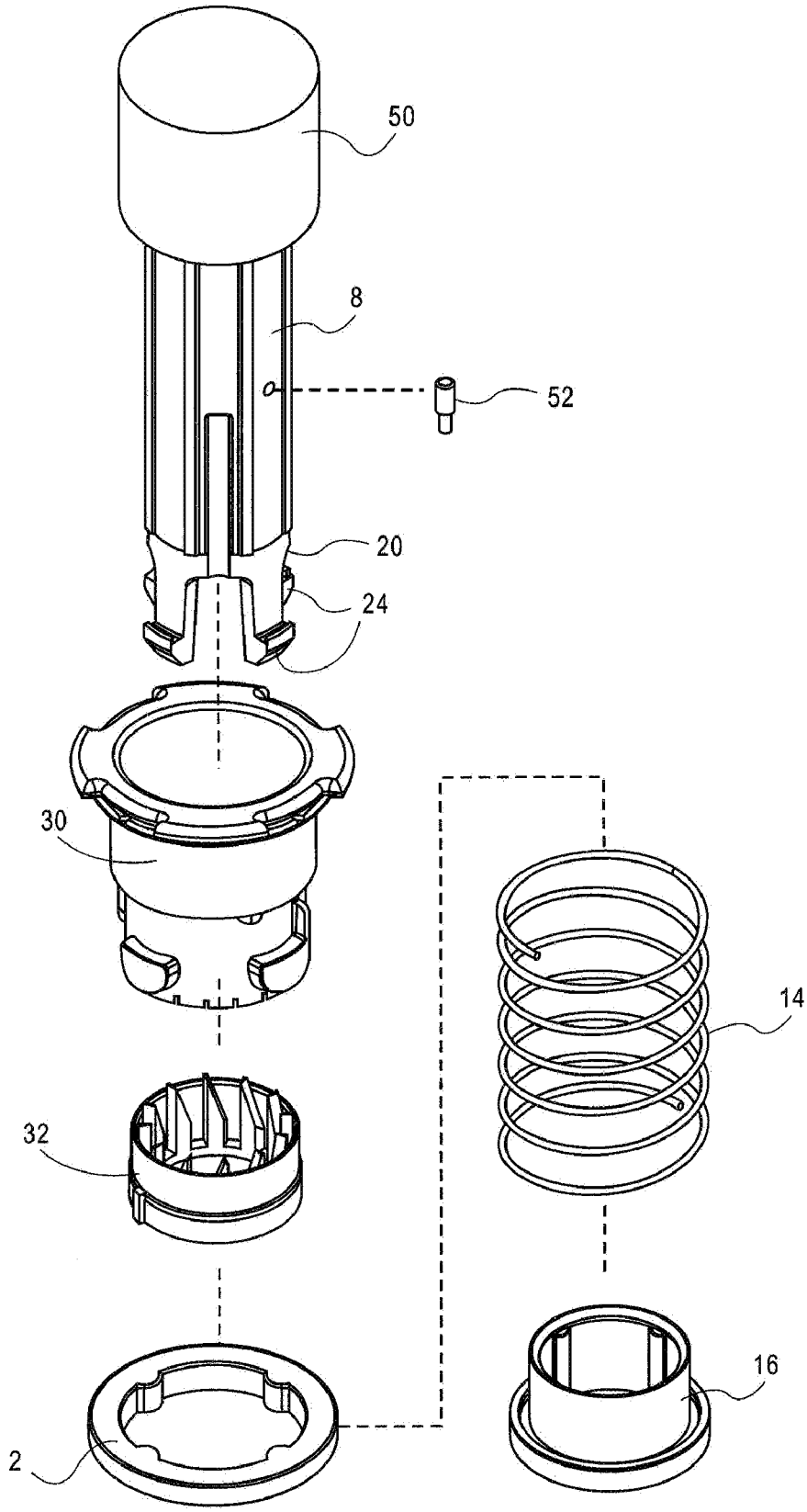
FIG. 11 is an exploded view of a particular implementation of a nozzle assembly showing an order of assembly of components.

FIG. 11 illustrates how the various parts of a particular implementation of a nozzle assembly 1 having flexible prongs 24 on a second end 26 may be assembled. A stem 8 containing a nozzle 50 may have a pin 52 coupled with a hole along its side to operatively engage with the cam teeth. Next, the upper cam half 30 may be coupled to the stem 8 over its second end 26. The lower cam half 32, upper washer 2, and spring element 14 may all each subsequently in turn be coupled to the stem 8 and each other over the stem's second end 26. The lower washer 16 may then be coupled to the stem 8 and retained by the flexible prongs 24 at the stem's second end 26. Since the lower washer 16 is retained by the flexible prongs 24, it serves to bias the spring element 14 against the upper washer 2. Once the nozzle assembly 1 has thus been assembled by coupling each component over the second end 26 of the stem 8, the assembly 1 can be inserted into a housing mounted in the side, stair, or floor of a body of liquid, such as a swimming pool, and connected to a pumping system.

It will be understood that implementations are not limited to the specific components disclosed herein, as virtually any components consistent with the intended operation of a method and/or system implementation for a nozzle assembly may be utilized. Accordingly, for example, although particular stems, spring elements, cams, and washers may be disclosed, such components may comprise any shape, size, style, type, model, version, class, grade, measurement, concentration, material, weight, quantity, and/or the like consistent with the intended operation of a method and/or system implementation for a nozzle assembly may be used.

In places where the description above refers to particular implementations of a nozzle assembly, it should be readily apparent that a number of modifications may be made without departing from the spirit thereof and that these implementations may be applied to other nozzle assemblies. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A nozzle assembly comprising:

a stem slidably coupled with a retainer such that the stem is slidable in relation to the retainer between an extended position and a retracted position, the stem comprising at least one cam portion, the stem further comprising a nozzle in a first end, the nozzle in fluid communication with a second end of the stem;

an upper washer slidably coupled with a washer race extending lengthwise along the stem, the upper washer comprising an upper washer groove in a bottom side of the upper washer;

a lower washer coupled with the second end of the stem, the lower washer comprising a lower washer groove in a top side of the lower washer and at least one inwardly extending projection configured to engage with the washer race in the stem; and a coil spring element disposed around the stem and seated in the upper washer groove and the lower washer groove, such that the spring element seated in the lower washer groove biases the upper washer toward and against the retainer in both the extended and retracted positions.

2. The nozzle assembly of claim 1, wherein the second end of the stem comprises a plurality of flexible prongs.

3. The nozzle assembly of claim 1, wherein the upper washer comprises a first mating element and the lower washer comprises a second mating element, the first and second mating elements configured to engage with each other.

4. The nozzle assembly of claim 1, wherein the at least one cam portion of the retainer comprises an upper cam half and a lower cam half slidably coupled into the upper cam half.

5. The nozzle assembly of claim 4, wherein the upper washer is biased against the lower cam half through the spring element.

6. The nozzle assembly of claim 4, wherein the lower cam half is removably coupled to the upper cam half and comprises an index to rotationally align the lower cam half with the upper cam half.

7. A nozzle assembly comprising:

a stem slidably coupled through a retainer assembly such that the stem is slidable in relation to the retainer assembly between an extended position and a retracted position, the stem comprising a nozzle in a first end, the nozzle in fluid communication with a second end of the stem;

the retainer assembly comprising an upper cam half and a lower cam half slidably coupled into the upper cam half;

an upper washer slidably coupled with a washer race extending lengthwise along the stem, the upper washer comprising an upper washer groove in a bottom side of the upper washer;

a lower washer coupled with the second end of the stem, the lower washer comprising a lower washer groove in a top side of the lower washer and at least one inwardly extending projection configured to engage with the washer race in the stem; and a coil spring element disposed around the stem and seated in the upper washer groove and the lower washer groove, such that the spring element seated in the lower washer groove biases the upper washer toward and against the lower cam half to bias the lower cam half into the upper cam half in both the extended and retracted positions.

8. The nozzle assembly of claim 7, wherein the upper washer is biased against an edge of the lower cam half through the spring element.

9. The nozzle assembly of claim 8, wherein the lower cam half comprises a plurality of cam teeth wherein the cam teeth comprise identical dimensions.

10. The nozzle assembly of claim 8, wherein the lower cam half comprises a plurality of cam teeth wherein at least one cam tooth differs in dimension from the other cam teeth.

11. The nozzle assembly of claim 7, wherein the second end of the stem comprises a plurality of flexible prongs.

12. The nozzle assembly of claim 7, wherein the upper washer comprises a first mating element and the lower washer comprises a second mating element, the first and second mating elements configured to engage with each other.

13. The nozzle assembly of claim 7, wherein the lower cam half is removably coupled to the upper cam half and comprises an index to rotationally align the lower cam half with the upper cam half.

14. A method of assembling a nozzle assembly, the method comprising:

providing a stem comprising a first end and a second end, the first end comprising a nozzle, the first end larger than the second end;

slidably engaging the stem with a retainer by sliding the second end of the stem through an opening in the retainer, the first end being larger than the opening in the retainer so that it does not pass through the opening;

slidably coupling an upper washer around the stem from the second end of the stem after slidably engaging the second end of the stem through the retainer;

coupling a spring element around the stem and against the upper washer from the second end of the stem after coupling the upper washer around the stem; and coupling a lower washer around the stem and against the spring element from the second end of the stem after coupling the spring element to the stem, such that the spring element biases against the lower washer to bias the upper washer against the retainer and at least one inwardly extending projection of the lower washer engages with a washer race in the stem.

15. The method of claim 14, wherein slidably engaging the retainer with the stem from the second end of the stem further comprises first slidably engaging a first cam half with the stem from the second end of the stem and then slidably engaging a second cam half with the stem from the second end of the stem.

16. The method of claim 15, wherein slidably engaging a second cam half with the stem from the second end of the stem further comprises slidably coupling the second cam half into the first cam half.

17. The method of claim 15, further comprising rotationally indexing the first cam half with the second cam half through an index on the second cam half.

18. The method of claim 14, wherein coupling the lower washer to the stem comprises coupling the lower washer to the stem through a plurality of flexible prongs on the second end of the stem that retain the lower washer.

* * * * *